US009234694B2

(12) United States Patent
Rivas

(10) Patent No.: US 9,234,694 B2
(45) Date of Patent: Jan. 12, 2016

(54) REFRIGERATION UNITS AND DOOR SYSTEMS FOR REFRIGERATION UNITS

(71) Applicant: REFRIGERACIÓN OJEDA, S.A. DE C.V., Iztacalco (MX)

(72) Inventor: Jorge Gonzalez Rivas, Iztacalco (MX)

(73) Assignee: REFRIGERACION OJEDA, Iztacalco DF (MX)

( * ) Notice: Subject to any disclaimer, the term of this patent is extended or adjusted under 35 U.S.C. 154(b) by 0 days.

(21) Appl. No.: 14/250,578

(22) Filed: Apr. 11, 2014

(65) Prior Publication Data

US 2015/0123533 A1 May 7, 2015

(30) Foreign Application Priority Data

Nov. 4, 2013 (MX) ..... MX/U/2013/000178

(51) Int. Cl.
*F25D 23/02* (2006.01)
*E06B 3/46* (2006.01)

(52) U.S. Cl.
CPC ..... *F25D 23/021* (2013.01); *E06B 3/4672* (2013.01); *F25D 23/026* (2013.01)

(58) Field of Classification Search
CPC ..... A47F 3/0408; A47F 3/043; A47F 3/0482; A47F 3/0443; A47F 3/125; F25D 23/021; F25D 23/026; F25D 23/028; F25D 23/082
See application file for complete search history.

(56) References Cited

U.S. PATENT DOCUMENTS 2,223,023 A * 11/1940 Weilemann ..... 220/345.5
2,276,635 A * 3/1942 Weber ..... 220/349
2,569,763 A * 10/1951 Hofferberth ..... 312/295
2,613,844 A * 10/1952 Mounce ..... 220/345.6
2,793,925 A * 5/1957 Rosen ..... 312/139.2
3,226,778 A * 1/1966 Kollsman et al. ..... 49/130
3,849,951 A * 11/1974 Howle ..... 52/19
4,741,570 A * 5/1988 Lovaas ..... 296/100.04
4,757,913 A * 7/1988 Yerman ..... 220/345.5
4,960,150 A * 10/1990 Ryan ..... 49/33
4,974,898 A * 12/1990 Baranski ..... 296/100.03
5,167,341 A * 12/1992 Morton et al. ..... 220/349
5,261,736 A * 11/1993 Sisbarro ..... 312/319.8
6,059,243 A * 5/2000 Hikage et al. ..... 248/311.2
6,088,963 A * 7/2000 Cawthon et al. ..... 49/33
6,145,942 A * 11/2000 Borgen ..... 312/138.1
6,206,227 B1 * 3/2001 Ferri, Jr. ..... 220/581
6,247,773 B1 * 6/2001 Harigai et al. ..... 312/405
6,595,381 B1 * 7/2003 Johnson ..... 220/345.1
7,584,843 B2 * 9/2009 Kutsch et al. ..... 206/267
8,430,460 B2 * 4/2013 Erro et al. ..... 312/116
2005/0052099 A1 * 3/2005 Behr et al. ..... 312/139.2
2005/0088062 A1 * 4/2005 Akimoto et al. ..... 312/116
2007/0001557 A1 * 1/2007 Cianetti ..... 312/116

* cited by examiner

*Primary Examiner* — Hanh V Tran
(74) *Attorney, Agent, or Firm* — J. Bennett Mullinax, LLC

(57) ABSTRACT

Refrigeration units and door systems for refrigeration units are provided. A door system for a refrigeration unit includes an outer frame and at least two sliding doors having the same size. Each door can include inner, outer, upper and lower sides that can have side outer surfaces presenting a seal profile that permits each door to seal when in a closed position. Each door can include pins extending outward from side outer surfaces of the upper and lower sides. The door system can include two parallel running rails within the outer frame. Each rail can include an upper sliding groove in which the pins of the sliding door run when the sliding doors move to an open position and a plurality of seating grooves that open up to the upper sliding grooves and extend downward from the upper sliding grooves in which the sliding doors reside in a closed position.

20 Claims, 4 Drawing Sheets

REFRIGERATION UNITS AND DOOR SYSTEMS FOR REFRIGERATION UNITS

RELATED APPLICATION

The presently disclosed subject matter claims the benefit of Mexican Patent Application Serial. No. MX/u/2013/000178, filed Apr. 11, 2013, the disclosure of which is incorporated herein by reference in its entirety.

TECHNICAL FIELD

The present subject matter relates generally to refrigeration units and more specifically to any commercial refrigerator or display to cool and store goods required for subsequent use. More particularly, the present subject matter involves a new door movement system for a refrigerator or freezer, which includes sliding doors.

BACKGROUND

Multitudes of individual coolers have been designed for the sale of ice cream. The purpose of these coolers is to have the ice cream product within the cooler cooled to a temperature that is below the ambient temperature surrounding the outside of cooler to obtain and maintain a product that will be cool and flavorful at serving.

Several types of refrigerators have been developed, which have different sized sliding doors that run over and about gutters that are overlapped and thus avoid or prevent heat input into the refrigerator. These sliding doors comprise a frame with glass to allow a perspective customer to see inside the refrigerator to view the content inside the refrigerator.

Generally, the sliding doors of refrigerators come in two sizes, one larger than the other to provide an overlap of the doors. However, for every such refrigerator, one door is larger than the other which can allow the doors to permit heat to enter the refrigerated area of the refrigerator due to the overlap which can be hard to seal. A need exists for sliding doors having one size that can be better aligned so as to achieve the proper tightness.

SUMMARY

In accordance with this disclosure, the present subject matter provides a lifting mechanism of the sliding doors of a display for storing all kinds of articles such as soft drinks, beverages, ice cream, grocery, etc. Those items are placed inside refrigerators to keep them cooled to a proper temperature until the items are ready to be removed for consumption.

Taking into account that some items are required to be cold or refrigerated, an object of the present invention can include having the versatility of a set of doors of equal dimensions within a refrigeration unit without thereby losing the sealing required to cool the articles contained in the refrigerator.

It is therefore an object of the present invention to have sliding doors of a display refrigeration unit, or refrigerator, which minimizes the size of the doors at a single size without requiring the doors to overlap when in a closed position.

Therefore, this invention is intended to optimize the size of sliding doors for refrigeration units while providing a benefit of having the products within a refrigeration unit suitable for consumption.

Some of the objects of the subject matter disclosed herein having been stated hereinabove, and which are achieved in whole or in part by the presently disclosed subject matter, other objects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

Figure 1:
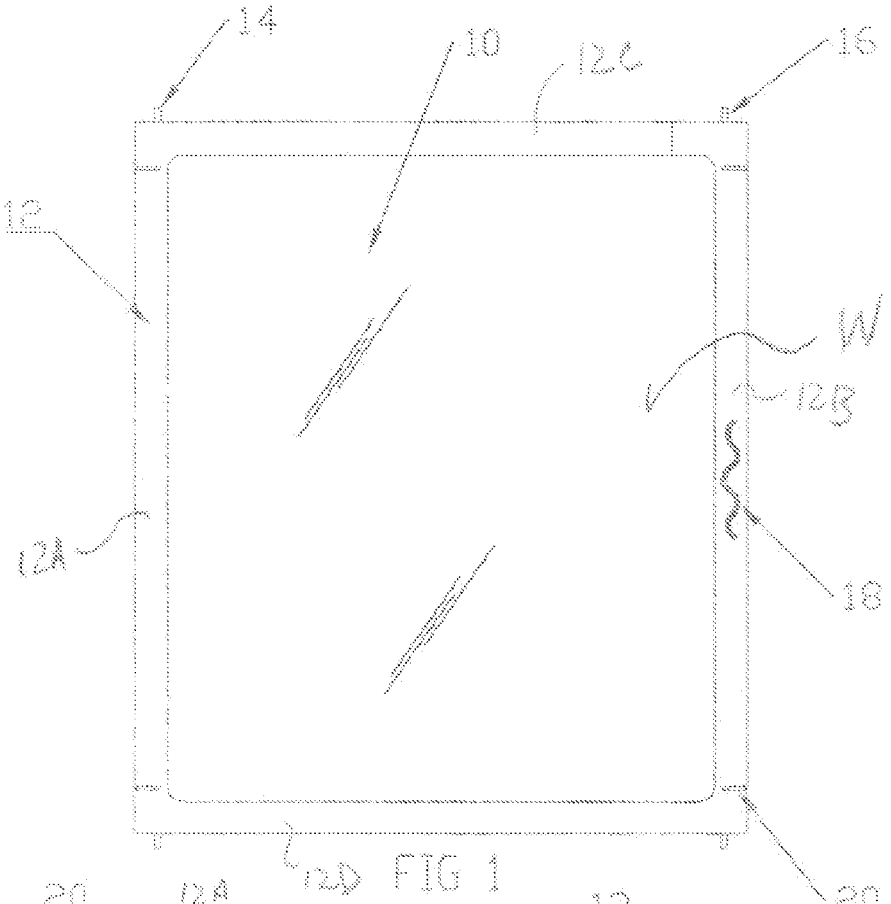
FIG. 1 is a front top view of an embodiment of a right sliding door for a door movement system in accordance with the present subject matter.

Repeat use of reference characters in the present specification and drawings is intended to represent the same or analogous features or elements of the invention.

DETAILED DESCRIPTION

Reference will now be made in detail to possible aspects or embodiments of the subject matter herein, one or more examples of which are shown in the figures. Each example is provided to explain the subject matter and not as a limitation. In fact, features illustrated or described as part of one embodiment can be used in another embodiment to yield still a further embodiment. It is intended that the subject matter disclosed and envisioned herein covers such modifications and variations.

Although the terms first, second, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, region, layer or section without departing from the teachings of the disclosure herein.

Similarly, when a layer or coating is being described in the present disclosure as "on" or "over" another layer or substrate, it is to be understood that the layers can either be directly contacting each other or have another layer or feature between the layers, unless expressly stated to the contrary. Thus, these terms are simply describing the relative position of the layers to each other and do not necessarily mean "on top of" since the relative position above or below depends upon the orientation of the device to the viewer.

Embodiments of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of a system or apparatus and are not intended to limit the scope of the subject matter disclosed herein.

The present subject matter relates to new door movement systems for a refrigerator or freezer, which can include a manual release mechanism for a sliding door rail that allows one of the doors to lift and slide to one side so that the sliding doors remain one above the other, either right door over the left door and/or vice versa. Each sliding door can comprise a frame that can include a pull tab on its upper surface and slider guides on which can rest the other door when in an open position. The lateral sides of the sliding doors can comprise electro technical mechanism for sliding the doors and a profile seal to prevent the entry of heat into the refrigerator.

Referring now to FIGS. 1-11, illustrations of embodiments of the door systems for a refrigeration unit according to the present subject matter are shown. In particular, sliding doors, generally designated 10 are provided. The sliding doors 10 of the present subject matter can comprise a metal frame 12 and can include glass through which one can observe the inside of the refrigerator. The metal frame 12 has a pull tab, or handle, 18 positioned thereon at a location that permits the movement of each of the doors 10. The metal frame 12 can carry at each end a terminal that serves as sliders, i.e., slider guides, 20 and which serve to support and on which will rest the sliding doors 10 once the sliding doors 10 are mounted. Towards the side portions, the sliding doors 10 comprises a series of sleeves, or pins, 14 and 16 placed at each end and which serve as guides of the sliding doors 10. The metal frame 12 can also present on the edge a profile seal 22 whose function is to close as tightly around the joint and not allow heat to enter into the refrigerator.

These sliding doors 10 can be seated on a rail having both ends and the center. A slanted housing, or rail center piece, 32 is provided where the sleeves, or pins, 14 are seated so as to slide either of the sliding doors 10 so that the door 10 that is sliding becomes elevated running up to and on the upper rail portion, i.e. upper sliding groove, 42 to lead the opening door 10 onto the sliders 20.

Since the manner of use is very simple, it is enough to move any of the sliding doors to the far opposing side to open the refrigerator. The sleeves, or pins, 14 will move so that, when you leave your place, the sliding door fixed can be set on the sliders 20. To close the procedure is the same.

The main feature is that both sliding doors are positioned adjacent and abutting one to the other when in a closed position instead of being overlapped as a generality. In such cases, it is no longer necessary that a door has a larger dimension to form an overlap.

Figure 10:
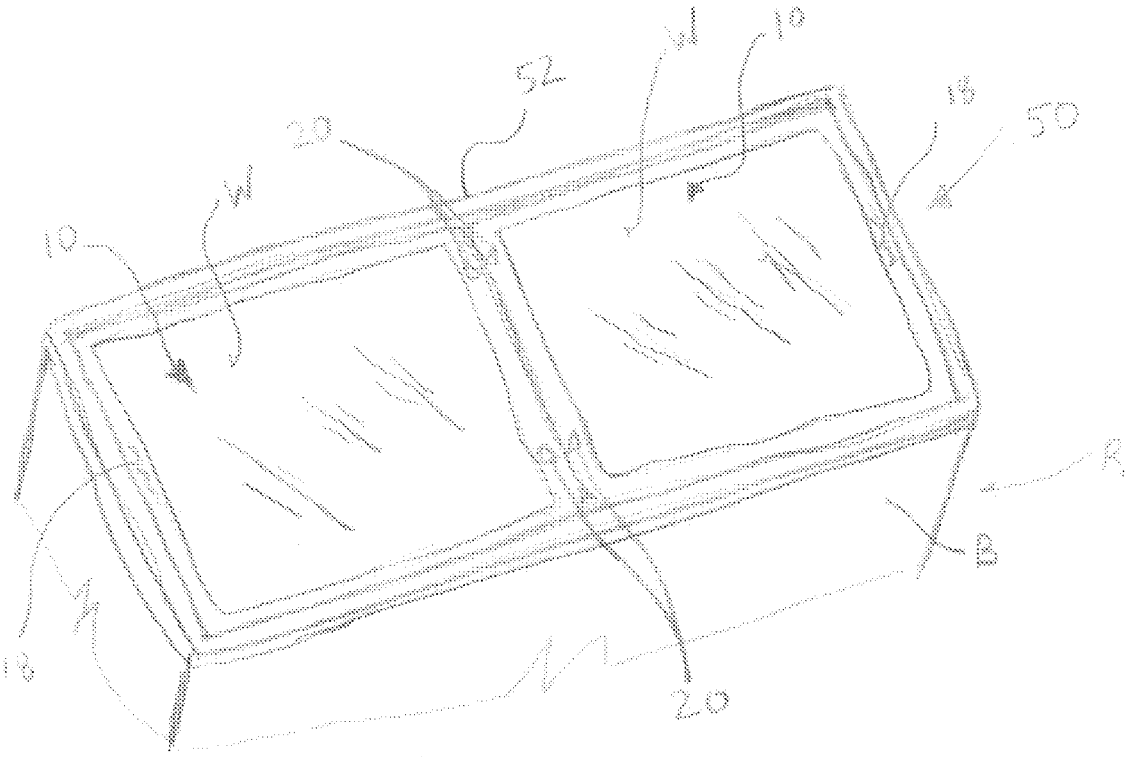
FIG. 10 is a top perspective view of an embodiment of a door system within a refrigeration unit in accordance with the present subject matter with the sliding doors in a closed position.
Figure 11:
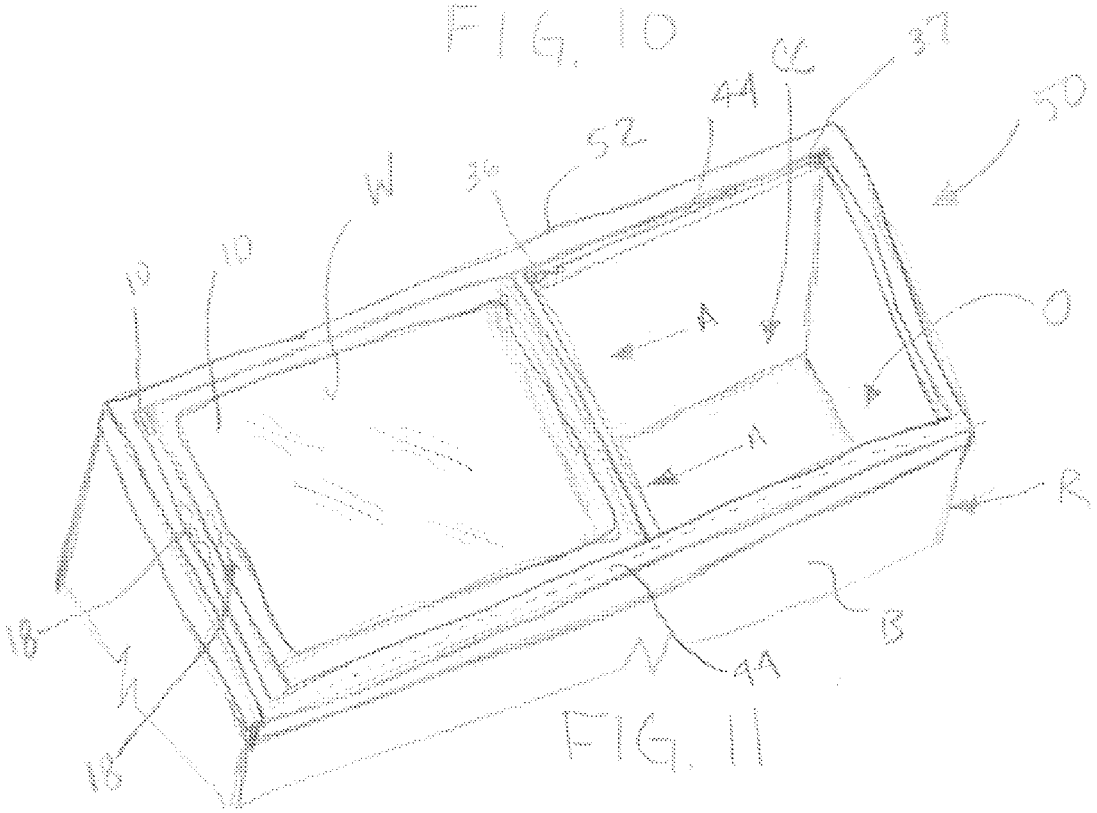
FIG. 11 is a top perspective view of the embodiment of a door system within a refrigeration unit according to FIG. 10 with the right sliding door in an open position.

As shown in FIGS. 10 and 11, a refrigeration unit, generally designated R, comprising a body B that can comprise a cooling chamber CC is provided. At least one opening can be formed with the body that can lead into the cooling chamber. The opening and/or the cooling chamber can be formed by the body. At least one opening O within the body B can lead into the cooling chamber CC. The body B and cooling chamber CC can be construction in a known manner. The refrigeration unit R can also comprise an embodiment of a door system, generally designated 50, that can comprise sliding doors 10 that can be disposed over the opening O in the body B and is configured to close the cooling chamber CC. Consumable products that can be refrigerated before purchase by a consumer can be placed in the cooling chamber CC of the body B of the refrigeration unit R. Depending on the temperature at which the refrigeration unit R is set by a control device (not shown) of the refrigeration unit R, different items can be placed in the cooling chamber CC. For example, in some embodiments, a temperature can be set that keeps items such as drinks, milk, cheese, yogurt, meats, etc., cool. In some embodiments, a temperature can be set for keeping frozen items such as ice cream, frozen dinners, frozen produce, or the like.

The door system 50 can be used to access cooling chamber CC when a consumer wants an item therein by opening one of the sliding doors 10 as shown, for example, in FIG. 11. At the same time the door system 50 helps to maintain the temperature in cooling chamber CC by keep heat out when the sliding doors 10 are closed as shown in FIG. 10. The door system 50 can comprise an outer frame 52 that has two parallel running rails 44 within the outer frame 52. The outer frame 52 can have two sliding doors 10 having the same size therein that engage the rails 44. The rails 44 within the outer frame 52 facilitate the sliding of the sliding doors 10 in and out of open positions as represented in FIG. 11 and closed positions as shown in FIG. 10.

Figure 2:
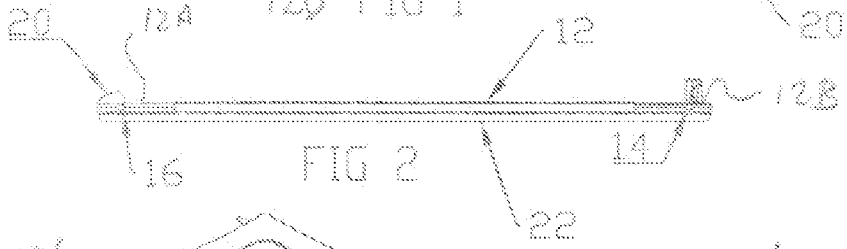
FIG. 2 is a side view of the embodiment of the right sliding door according to FIG. 1 for a door movement system in accordance with the present subject matter.
Figure 3:
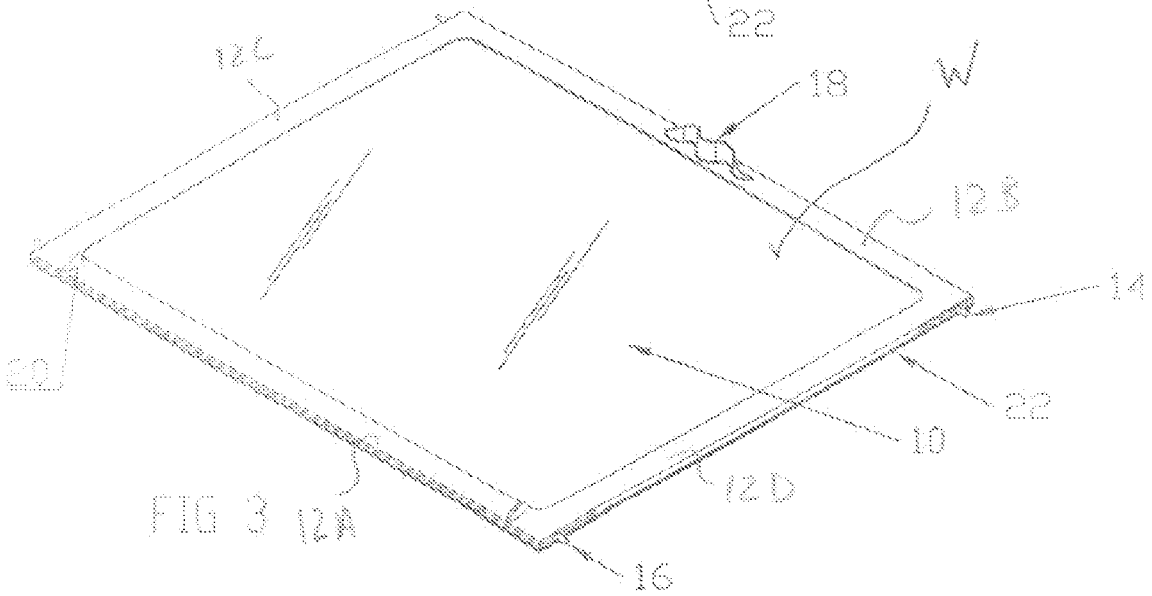
FIG. 3 is a perspective view of the embodiment of the right sliding door according to FIG. 1 for a door movement system in accordance with the present subject matter.
Figure 4:
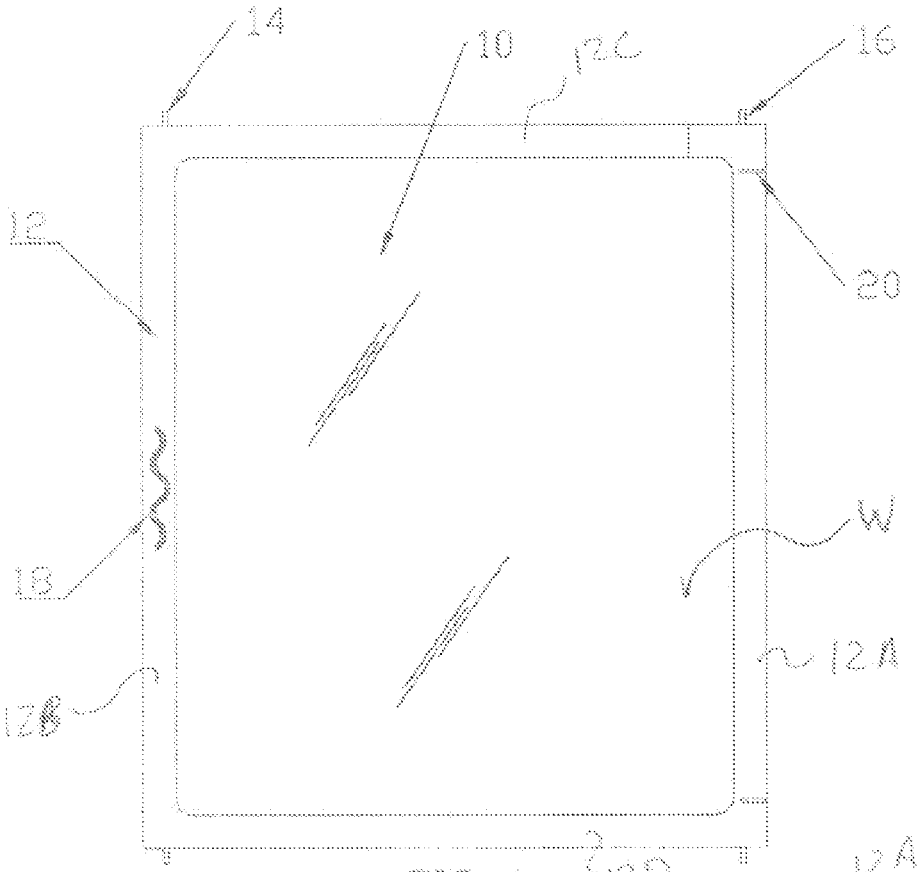
FIG. 4 is a front top view of an embodiment of a left sliding door in a door movement system in accordance with the present subject matter.
Figure 5:
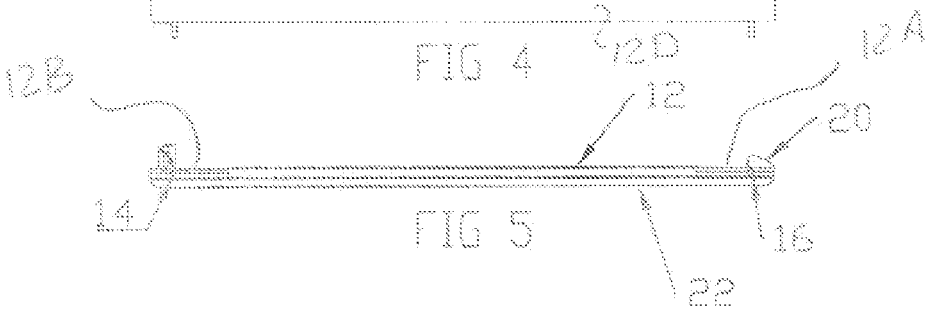
FIG. 5 is a side view of the embodiment of the left sliding door according to FIG. 4 for a door movement system in accordance with the present subject matter.
Figure 6:
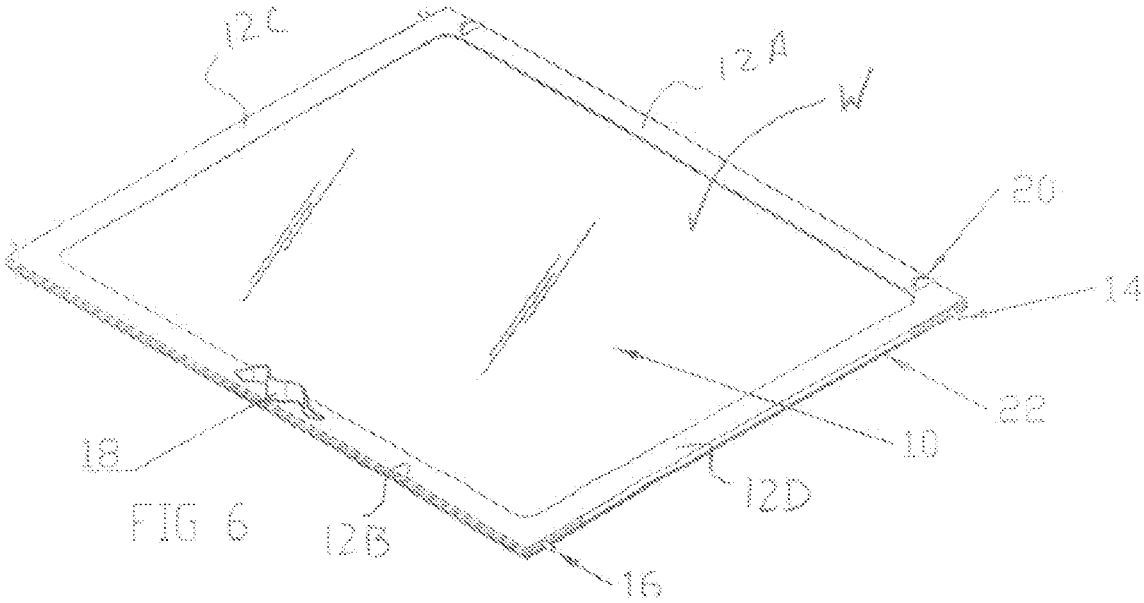
FIG. 6 is a perspective view of the embodiment of the left sliding door according to FIG. 4 for a door movement system in accordance with the present subject matter.

As shown in FIGS. 1-6, the two sliding doors 10 comprise a right sliding door 10 shown in FIGS. 1-3 and a left sliding door 10 shown in FIGS. 4-6 that can mirror each other. Referring to FIGS. 1-3, the right door 10 can comprise a frame 12 with an inner side 12A, an outer side 12B, an upper side 12C and a lower side 12D. The frame 12 can have one or more slider guides 20 on a top surface of the inner side 12A of the frame. The slider guides 20 can serve as support for the left sliding door 10 when the left sliding door 10 is in an open position and/or sliding into an open position. The inner side 12A, outer side 12B, upper side 12C and lower side 12D can have side outer surfaces that present a profile 22 that permits the right door 10 to seal tightly when in a closed position. The right door 10 can also comprise pins 14, 16 extending outward from a side outer surface of the upper side 12C and a side outer surface of the lower side 12D of the frame 12.

Similarly, the left door 10 shown in FIGS. 4-6 can comprise a frame 12 with an inner side 12A, an outer side 12B, an upper side 12C and a lower side 12D. The frame 12 can have one or more slider guides 20 on a top surface of the inner side 12A of the frame. The slider guides 20 can serve as support for the left sliding door 10 when the left sliding door 10 is in an open position and/or sliding into an open position. The inner side 12A, outer side 12B, upper side 12C and lower side 12D can have side outer surfaces that present a profile 22 that permits the right door 10 to seal tightly when in a closed position. The right door 10 can also comprise pins 14, 16 extending outward from a side outer surface of the upper side 12C and a side outer surface of the lower side 12D of the frame 12.

In some embodiments, each of the sliding doors 10 can comprise a window W held within the frame 12. The windows W can provide the potential customer the opportunity to view into the refrigeration unit R without having to open the sliding doors 10. In such embodiments, each of the windows W in the sliding doors 10 can comprise glass. The glass can be transparent to provide a clear view or translucent. Further, each of the sliding doors 10 can comprise a handle, or pull, 18 disposed on an upper surface of the outer side 12B of the frame 12. In some embodiments, the frames 12 of the sliding doors 10 can be made of a metal.

Figure 7:
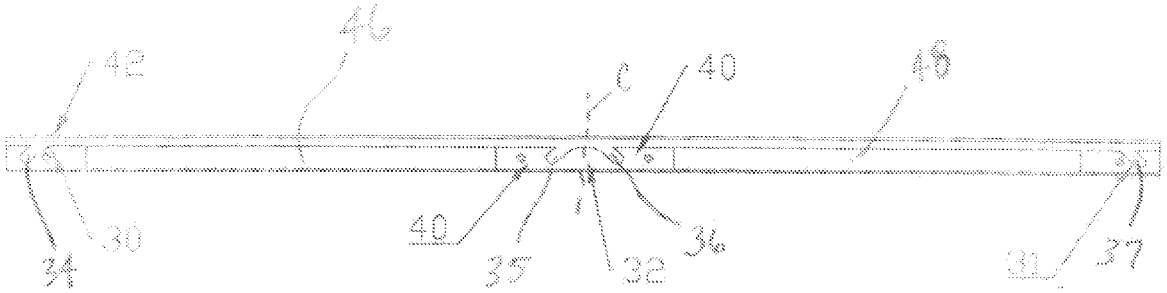
FIG. 7 is a side view of an embodiment of one rail of two parallel running rails of an outer frame for the doors according to FIGS. 1-6 of an embodiment of a door movement system in accordance with the present subject matter through which the door slides.
Figure 8:
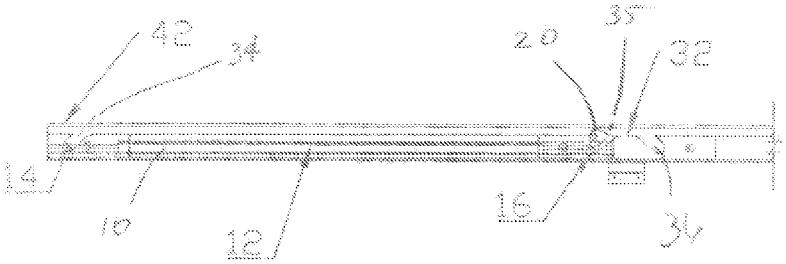
FIG. 8 is a side view of the left door mounted in a closed position on the rail of two parallel running rails of the outer frame according to FIG. 7 of an embodiment of a door movement system in accordance with the present subject matter through which the door slides.
Figure 9:
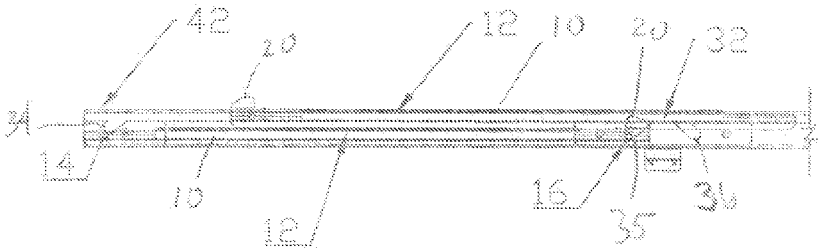
FIG. 9 is a front view of the left door mounted in a closed position and the right door pull over into an open position above the left door on the rail of two parallel running rails of the outer frame for the doors according to FIG. 7 of an embodiment of a door movement system in accordance with the present subject matter.

Referring to FIGS. 7-11, while only one rail is shown in detail, it is understood that the two rails parallel each other and also are mirror images of each other. Thus, the grooves and rail pieces shown in one rail are the same or similar to the grooves and rail pieces in the matching rail. The rails 44 in the outer frame 52 can be aligned with the upper and lower sides 12C, 12D of the sliding doors 10 as shown in FIGS. 8-11. Each rail 44 can comprise an upper sliding groove 42 in which the pins 14, 16 of the sliding doors 10 run when the sliding doors 10 are being moved to an open position. The rails 44 can also comprise a plurality of seating grooves 34, 35, 36, 37 that open up to the upper sliding grooves 42 and extend downward from the upper sliding grooves 42. When the rails 44 and the sliding doors 10 are installed, the pins 14, 16 can reside in the seating grooves 34, 35, 36, 37 when the sliding doors 10 are in a closed position as shown in FIGS. 8 and 10. The sliding doors 10 can reside in the same plane when the sliding doors 10 are in a closed position. When one of the sliding doors 10 is in an open position, the sliding doors 10 can reside in parallel planes. As shown in FIGS. 9 and 11, the right door 10 has been pushed in a direction A to the left out of the closed position and up the seating grooves 36, 37 that are slanted toward the left sliding door 10 on to the upper sliding grooves. In the open position of the right sliding door 10 as shown in FIGS. 9 and 11, the right sliding door 10 resides in a separate plane above the left sliding door 10 on the sliders 20 with the pins 14 and 16 within the upper sliding grooves 42. In this manner, the seating grooves 34, 35, 36, 37 can serve as ramps, or ramp surfaces, for facilitating the movement of the pins 14, 16 of the sliding doors 10 up to the upper sliding grooves 42 to open the sliding doors 10 and down into the seating grooves 34, 35, 36, 37 to close the sliding doors 10.

Each of the seating grooves 34, 35, 36, 37 in each of the rails 44 can be slanted toward a center C of the rails 44 as shown in FIGS. 7-9. Two of the seating grooves 34, 35 can be on one side of the center C of the respective rail 44, while two of the seating grooves 36, 37 can be on an opposite side of the center C of the respective rail 44. The pins 14, 16 of the left sliding door 10 can reside in seating grooves 34, 35 when the left sliding door 10 is in a closed position. Since the seating grooves 34, 35 are slanted in the same direction toward the center C of the respective rail 44, the pins 14, 16 of the left sliding door 10 will ride up the slant of the seating grooves 34, 35 as the left sliding door 10 is pushed by the handle 18 toward the opposing side of the outer frame 52 and the center C of the rails 44 and onto the upper sliding grooves 42. The seating grooves 36, 37 are slanted in the same direction as each other toward the center C of each respective rail 44 but in the opposite upward direction toward the upper sliding groove 42 in each respective rail 44 as compared to the seating grooves 34, 35. In this manner, the pins 14, 16 of the right sliding door 10 will also ride up the slant of the seating grooves 36, 37 as the left sliding door 10 is pushed by the handle 18 toward the opposing side of the outer frame 52 and the center C of the rails 44 and onto the upper sliding grooves 42.

The seating grooves 34, 35, 36, 37 can be deep enough to hold a first sliding door 10 in a closed position when its pins 14, 16 are seated in the bottom of the seating grooves 34, 35, 36, 37 and allow the second sliding door 10 moved or being moved to an open position with its pins 14, 16 in the upper sliding grooves 42 to reside overtop the first sliding door 10. Additionally, in some embodiments, the seating grooves 34, 35, 36, 37 can have depths and positions along the rail 44 that hold the sliding doors 10 in side by side and a abutting on the end such that the profiles 22 can keep or at least limit heat from entering the cooling chamber CC between the doors 10 when the sliding doors 10 are in a closed position. Thereby, when the sliding doors 10 are in a closed position, the sliding doors 10 can reside in the same plane and when one of the sliding doors 10 is in an open position, the sliding doors can reside separate but generally parallel planes.

In some embodiments, the slider guides 20 can reside on opposing sides of the frame 12. For example, the slider guides 20 can be on both the inner side 12A and the outer side 12B of the frame 12 of each door. The slider guides 20, whether on one or both of the inner side 12A and the outer side 12B can provide support to the other respective open door and can prevent or aid in preventing the pins 14, 16 of the opened door 10 from entering the respective seating grooves 34, 35, 36, 37 in which the pins 14, 16 of other closed sliding door 10 still reside. In some embodiments, the slider guides 20 can reside on one or both of the upper and lower sides 12C, 12D of the frame 12 and still serve the same or similar purpose, if properly positioned thereon.

As shown in FIG. 7, in some embodiments, each rail can comprise two rail end pieces 30, 31 with each rail end piece 30, 31 having a slanted seating groove 34, 37 therein with the respective slanted seating groove 34, 37 slanted upward toward the center C of the respective rail 44. Each rail 44 can also comprise a rail center piece 32 that can have two seated grooves 35, 36 slanted toward each other. The rail center piece 32 can be secured to the outer frame 52 with fasteners 40. Similarly, the rail end pieces 30, 31 can also be secured to the outer frame 52 with fasteners 41. The placement of the rail center piece 32 within the respective rail 44 can align the slanted seating grooves 35, 36 within the rail center piece 32 so that the slanted seating grooves 35, 36 within the rail center piece 35, 36 can be slanted toward the center C of the respective rail 44 as shown in FIG. 7. Further, each rail 44 can comprise two middle rail pieces 46, 48. One of the middle rail piece 46 can be between the rail end piece 30 and the rail center piece 32 and the other middle rail piece 48 can be between the other rail end piece 31 and the center piece 32. The middle rail pieces 46, 48 can provide linear guide surfaces on which the sliding doors 10 run when moving to an open position. In particular, the pins 14, 16 of the sliding doors 10 can run on the linear guide surfaces of the middle rail pieces 46, 48 when a respective sliding door 10 is being moved to an open position once the pins have moved up the ramped surface of the respective slanted seating grooves 34, 35, 36, 37 onto the linear guide surfaces of the middle rail pieces 46, 48. In such embodiments, each of the seating grooves 34, 35, 36, 37 can still be slanted toward a center C of the respective rail 44 as shown in FIGS. 7-9.

Thus, as shown in the figures and disclosed herein, a door system for a refrigeration unit can be provided that can comprise an outer frame and at least two sliding doors having the same size. Each door can comprise an inner side, an outer side, an upper side and a lower side. The inner side, outer side, upper side and lower side can have side outer surfaces. These side outer surfaces can present a seal profile that permits each door to seal tightly when in a closed position. Each door can also comprise pins extending outward from a side outer surface of the upper side and a side outer surface of the lower side of the door that can help hold the doors in the outer frame of the door and permit the sliding of the doors from an open position and closed position.

The door system can also comprise two parallel running rails that reside within the outer frame. The rails can align with the upper and lower sides of the sliding doors. Each rail can comprise an upper sliding groove in which the pins of the sliding door run when one or the other of the sliding doors is being moved to an open position. Each rail can also comprise a plurality of seating grooves that open up to the upper sliding grooves and extend downward from the upper sliding grooves. The pins of each of the sliding doors can be moved into respective seating grooves. When the pins of each of the sliding doors are in their respective seating groove, the sliding doors can be in a closed position. In such embodiments of the door system, the sliding doors can reside in the same plane when the sliding doors are in a closed position and the sliding doors can reside in two parallel planes when one or the other of the sliding doors is in an open position.

Each of the sliding doors can comprise a window to permit an interior portion of the refrigeration unit to be viewed. Each of the windows in the sliding doors can comprise a transparent glass. Each of the sliding doors can comprise a handle disposed on an upper surface of the outer side of the door. One or more slider guides can be positioned on a top surface of the inner side. The slider guides can serve as support for the other sliding door when the other sliding door is in an open position.

Each of the seating grooves in each of the rails can be slanted toward a center of the rails. Two of the seated grooves can be on one side of the center of the respective rail and two of the seat grooves can be on an opposite side of the center of the respective rail. Each of these seating grooves can be slanted toward a center of the respective rail.

In some embodiments, each rail can comprise two rail end pieces with each end piece having a slanted seating groove therein with the slanted seated groove slanted toward the center of the respective rail. Each rail can comprise a rail center piece that can have two seating grooves slanted toward each other. The placement of the rail center piece within the respective rail can align the slanted seated grooves within the center piece so that the slanted seating grooves therein are slanted toward the center of the respective rail. Each rail can comprise two middle rail pieces with one middle rail piece between one rail end piece and the rail center piece and the other middle rail piece between the other rail end piece and the rail center piece. In such embodiments, the middle rail pieces can provide linear guide surfaces on which the sliding doors run when the respective sliding door is moving to an open position.

Similarly, a refrigeration unit can be provided that can comprise a body. The body can comprise a cooling chamber for holding items therein that are to be cooled. At least one opening can be formed with the body that can lead into the cooling chamber. The opening and/or the cooling chamber can be formed by the body. The refrigeration unit can also comprise a door system disposed over the at least one opening in the body the door system configured to close the cooling chamber. The door system used within the refrigeration unit can be the same or similar to those described above. For example, the door system can comprise an outer frame and at least two sliding doors having the same size. Each sliding door can comprise an inner side, an outer side, an upper side and a lower side. In some embodiments, one or more slider guides can reside on a top surface of the inner side. The slider guides serving as support for the other sliding door when the other sliding door is in an open position. The inner side, outer side, upper side and lower side can have side outer surfaces that can comprise or form a seal profile that permits each door to seal tightly when in a closed position. Each of the sliding doors can also comprise pins extending outward from the side outer surface of the upper side and the side outer surface of the lower side of the door. The sliding doors can further comprise two parallel running rails within the outer frame. The rails can align the upper and lower sides of the sliding doors. Each rail can comprise an upper sliding groove in which the pins of the sliding doors run when the sliding doors are being moved to an open position and a plurality of seating grooves that open up to the upper sliding grooves and extend downward from the upper sliding grooves. The pins can reside in the seating grooves when the sliding doors are in a closed position. The sliding doors can reside in the same plane when the sliding doors are in a closed position and the sliding doors can reside in parallel planes when one of the sliding doors is in an open position.

While the present subject matter has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims. The present subject matter can be embodied in other forms without departure from the spirit and essential characteristics thereof. The embodiments described therefore are to be considered in all respects as illustrative and not restrictive. Although the present subject matter has been described in terms of certain embodiments, other embodiments that are apparent to those of ordinary skill in the art are also within the scope of the present subject matter.

What is claimed is:

1. A door system for a refrigeration unit comprising:

an outer frame for holding sliding doors;

at least two sliding doors having the same size, each door comprising:

a frame with an inner side, an outer side, an upper side and a lower side and one or more slider guides on a top surface of the inner side, the slider guides serving as support for the other sliding door when the other sliding door is in an open position;

the inner side, outer side, upper side and lower side having side outer surfaces that present a profile that permits each door to seal tightly when in a closed position;

pins extending outward from a side outer surface of the upper side and a side outer surface of the lower side of the frame so that the ins extend in the same plane as the respective sliding door;

two parallel running rails within the outer frame, the rails aligning with the upper and lower sides of the sliding doors, each rail comprising an upper sliding groove in which the pins of the sliding door run when the sliding doors are being moved to an open position and a plurality of seating grooves that open up to the upper sliding grooves and extend downward from the upper sliding grooves, the pins residing in the seating grooves when the sliding doors are in a closed position;

the one or more slider guides being positioned on the frame of each sliding door to aid in preventing the pins of one of the sliding doors being opened from entering the respective seating grooves in which the pins of the other closed sliding door still reside; and the sliding doors residing in the same plane when the sliding doors are in a closed position and the sliding doors residing in two parallel planes when one of the sliding doors is in an open position.

2. The door system according to claim 1, wherein each of the sliding doors comprises a window held within the frame.

3. The door system according to claim 2, wherein the window comprises a transparent glass.

4. The door system according to claim 1, wherein each of the sliding doors comprises a handle disposed on an upper surface of the outer side of the frame.

5. The door system according to claim 1, wherein the frame of each of the sliding doors comprises a metal.

6. The door system according to claim 1, wherein each of the seating grooves in each of the rails is slanted toward a center of the rails.

7. The door system according to claim 6, wherein two of the seating grooves are on one side of the center of the respective rail and two of the seating grooves are on an opposite side of the center of the respective rail with each of the seating grooves slanted toward a center of the respective rail.

8. The door system according to claim 6, wherein each rail comprises two rail end pieces with each rail end piece having a slanted seating groove therein with the slanted seating groove slanted toward the center of the respective rail.

9. The door system according to claim 8, wherein each rail comprises a rail center piece that has two seating grooves slanted toward each other, the placement of the rail center piece within the respective rail aligns the slanted seating grooves within the rail center piece so that the slanted seating groove are slanted toward the center of the respective rail.

10. The door system according to claim 9, wherein each rail comprises two middle rail pieces with one middle rail piece between one rail end piece and the rail center piece and the other middle rail piece between the other rail end piece and the rail center piece, the middle rail pieces providing linear guide surfaces on which the sliding doors run when moving to an open position.

11. A door system for a refrigeration unit comprising:

an outer frame for holding sliding doors;

at least two sliding doors having the same size, each door comprising:

a frame with an inner side, an outer side, an upper side and a lower side;

the inner side, outer side, upper side and lower side having side outer surfaces that present a seal profile that permits each door to seal tightly when in a closed position;

pins extending outward from the side outer surface of the upper side and the side outer surface of the lower side of the door so that the pins extend in the same plane as the respective sliding door;

two parallel running rails within the outer frame, the rails aligning with the upper and lower sides of the sliding doors, each rail comprising an upper sliding groove in which the pins of the sliding door run when the sliding doors are being moved to an open position and a plurality of seating grooves that open up to the upper sliding grooves and extend downward from the upper sliding grooves, the pins residing in the seating grooves when the sliding doors are in a closed position; and the sliding doors residing in the same plane when the sliding doors are in a closed position and the sliding doors residing in parallel planes when one of the sliding doors is in an open position; one or more slider guides being positioned on the frame of each sliding door to aid in preventing the pins of one of the sliding doors being opened from entering the respective seating grooves in which the pins of the other closed sliding door still reside.

12. The door system according to claim 11, wherein each of the sliding doors comprises a window to permit an interior portion of the refrigeration unit to be viewed.

13. The door system according to claim 11, wherein the one or more slider guides position on a top surface of the inner side of the frame, the one or more slider guides serving as support for the other sliding door when the other sliding door is in an open position.

14. The door system according to claim 11, wherein each of the sliding doors comprises a handle disposed on an upper surface of the outer side of the door.

15. The door system according to claim 11, wherein each of the seating grooves in each of the rails is slanted toward a center of the rails.

16. The door system according to claim 15, wherein two of the seating grooves are on one side of the center of the respective rail and two of the seating grooves are on an opposite side of the center of the respective rail with each of the seating grooves slanted toward a center of the respective rail.

17. The door system according to claim 15, wherein each rail comprises two rail end pieces with each rail end piece having a slanted seating groove therein with the slanted seating groove slanted toward the center of the respective rail.

18. The door system according to claim 17, wherein each rail comprises a rail center piece that has two seating grooves slanted toward each other, the placement of the rail center piece within the respective rail aligns the slanted seating grooves within the rail center piece so that the slanted seating groove are slanted toward the center of the respective rail.

19. The door system according to claim 18, wherein each rail comprises two middle rail pieces with one middle rail piece between one rail end piece and the rail center piece and the other middle rail piece between the other rail end piece and the rail center piece, the middle rail pieces providing linear guide surfaces on which the sliding doors run when moving to an open position.

20. A refrigeration unit comprising:

a body comprising a cooling chamber for holding items therein and at least one opening leading into the cooling chamber formed by the body; and a door system disposed over the at least one opening in the body the door system configured to close the cooling chamber, the door system comprising:

an outer frame for holding sliding doors;

at least two sliding doors having the same size, each door comprising:

a frame with an inner side, an outer side, an upper side and a lower side;

the inner side, outer side, upper side and lower side having side outer surfaces that present a seal profile that permits each door to seal tightly when in a closed position; and pins extending outward from the side outer surface of the upper side and the side outer surface of the lower side of the door so that the pins extend in the same plane as the respective sliding door;

two parallel running rails within the outer frame, the rails aligning with the upper and lower sides of the sliding doors, each rail comprising an upper sliding groove in which the pins of the sliding door run when the sliding doors are being moved to an open position and a plurality of seating grooves that open up to the upper sliding grooves and extend downward from the upper sliding grooves, the pins residing in the seating grooves when the sliding doors are in a closed position;

one or more slider guides being positioned on the frame of each sliding door to aid in preventing the pins of one of the sliding doors being opened from entering the respective seating grooves in which the pins of the other closed sliding door still reside; and the sliding doors residing in the same plane when the sliding doors are in a closed position and the sliding doors residing in parallel planes when one of the sliding doors is in an open position.

* * * * *